US006554275B1

(12) United States Patent
Tranquilla

(10) Patent No.: US 6,554,275 B1
(45) Date of Patent: Apr. 29, 2003

(54) METHOD AND SYSTEM FOR DOCUMENT OVERLAP/GAP ERROR DETECTION AND CORRECTION

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/004,573

(22) Filed: Dec. 4, 2001

(51) Int. Cl.[7] ..... B65H 7/02

(52) U.S. Cl. ..... 271/259; 271/110; 271/111; 271/258.01; 271/258.02; 271/265.01; 271/265.02; 271/270; 271/272

(58) Field of Search ..... 271/110, 111, 271/258.01, 259, 258.02, 265.01, 265.02, 270, 272, 265.04, 263

(56) References Cited

U.S. PATENT DOCUMENTS 4,171,130 A * 10/1979 Jeschke et al. ..... 271/10.03
4,331,328 A * 5/1982 Fasig ..... 271/270
4,775,139 A * 10/1988 Honjo et al. ..... 271/10.03
4,893,804 A * 1/1990 Sasage et al. ..... 271/3.09
5,462,267 A * 10/1995 Hori ..... 271/10.04
5,482,265 A * 1/1996 Nakazato et al. ..... 271/242
5,848,784 A 12/1998 Tranquilla
6,199,854 B1 3/2001 Tranquilla et al.
6,224,049 B1 * 5/2001 Hosking et al. ..... 271/10.03
6,364,308 B1 * 4/2002 Tranquilla ..... 271/37

* cited by examiner

*Primary Examiner*—Donald P. Walsh
(74) *Attorney, Agent, or Firm*—Brooks & Kushman, P.C.; Lise A. Rode; Mark T. Starr

(57) ABSTRACT

A method of document overlap/gap error detection and correction includes detecting a trailing edge of a first document at a feeder, and detecting a leading edge of a second document at an edge detector between the feeder and a transport stage. An overlap/gap error is determined and the feeder is controlled to correct the overlap/gap error, when the error is present. An overlap may be measured before the first document trailing edge arrives at the edge detector, providing a greater remaining length of the second document left in the feeder with which to perform the necessary feeder motions to correct the overlap/gap error.

15 Claims, 3 Drawing Sheets

METHOD AND SYSTEM FOR DOCUMENT OVERLAP/GAP ERROR DETECTION AND CORRECTION

BACKGROUND OF THE INVENTION

1. Field of the Invention

The present invention relates to systems for feeding and transporting documents and to a method and system for document overlap/gap error detection and correction.

2. Background Art

A typical system for feeding and transporting documents includes a feeder and a separator in the document feeding portion of the system, and a series of roller pairs or belts in the document transporting portion of the system. In the feeding portion of the system, the feeder acts with the separator to feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. The separator may be a wheel, but also may take other forms such as a belt. Further, the components in the transporting portion of the system may take a variety of forms. Systems also include a component in the document feeding portion of the system that nudges documents into the nip between the feeder and the separator. A suitable nudger may be a nudger wheel, but may take other forms. An existing document feeder is shown in U.S. Pat. No. 6,199,854. That patent describes a document feeder with a variable speed separator.

In systems for feeding and transporting documents, it is critical that there is sufficient space between documents so that each document can be detected individually and processed by processing devices downstream of the initial roller pairs and/or belts of the transporting portion of the system. For example, sufficient space between documents would be required so that each document can be detected individually and processed by a check sorter, imager, or printer. Some existing systems rely solely on the speed difference between the first document driver beyond the feeder, known as the document accelerator, and the feeder. That is, the accelerator runs at a higher peripheral speed than the feeder such that the documents become separated as the documents pass through the accelerator. This separation technique is completely mechanical, and although used in some applications that have been successful, does not account for the fact that documents are occasionally fed overlapped from the feeder.

Previous overlap correctors wait until the trailing edge of the first, leading, document reached a downstream sensor before attempting to correct the document spacing. U.S. Pat. No. 5,848,784 describes a document separation apparatus. That patent describes the downstream accelerator/deceleration of documents with pinch rollers to adjust document spacing. Although the downstream acceleration/deceleration of documents with pinch rollers to adjust document spacing is sufficient for many applications, in certain situations it would be desirable to measure an overlap sooner, that is, before the trailing edge of the first, leading, document reaches the downstream sensor, so that there is greater distance of the second, following, document remaining to perform the correction.

For the foregoing reasons, there is a need for an improved method and system for document overlap/gap error detection and correction.

SUMMARY OF THE INVENTION

It is, therefore, an object of the present invention to provide a method and system for document overlap/gap error detection and correction that may measure an overlap before the first document trailing edge arrives at the downstream edge detector.

In carrying out the above object, a method of document overlap/gap error detection and correction in a system for feeding and transporting documents is provided. Each document has a leading edge and a trailing edge. The system includes a feeder stage and a transport stage downstream of the feeder stage for receiving a document from the feeder stage. The feeder stage includes a controllable feeder and a separator for receiving the document therebetween. The system includes at least one edge detector between the feeder stage and the transport stage for detecting passing document edges during operation of the system. The method comprises detecting a trailing edge of a first document at the feeder, and detecting a leading edge of a second document at the at least one edge detector. The second document follows the first document and the second document is still received between the feeder and the separator when the second document leading edge is detected at the at least one edge detector. The method further comprises determining an overlap/gap error, if any, between the first document and the second document based on the first document trailing edge detection and the second document leading edge detection. The feeder is controlled to correct the overlap/gap error, when the error is present.

Embodiments of the present invention may determine the overlap/gap error in a variety ways. In one embodiment, determining the overlap/gap error further comprises, after detecting the first document trailing edge, operating the feeder at a constant velocity until detecting the second document leading edge. The overlap/gap error, if any, between the first document and the second document is determined based on an elapsed time between the first document trailing edge detection and the second document leading edge detection.

In another embodiment, determining the overlap/gap error further comprises providing a tachometer at the feeder, with the tachometer generating an output. The overlap/gap error, if any, between the first document and the second document is determined based on the tachometer output between the first document trailing edge detection and the second document leading edge detection. The tachometer may be implemented in any suitable way. For example, the tachometer may include an encoder and generate a pulse sequence as the tachometer output. For example, the tachometer may generate an analog velocity output as the tachometer output.

Further, in some embodiments of the present invention, the at least one edge detector is a single edge detector. In preferred embodiments, the at least one edge detector is a sequence of edge detectors. In a preferred embodiment that utilizes the sequence of edge detectors, the leading edge of the second document may be detected at an edge detector in the sequence at the same time as detecting the trailing edge of the first document at the feeder. That is, in single edge detector embodiments, moving the single edge detector closer to the feeder provides earlier detection. Moving the single edge detector closer to the transport stage, although providing slightly later detection, allows for detection of greater overlaps. The single sensor embodiments may be suitable for many applications depending on the range of expected overlaps and gaps and the extent that detection must occur early. Preferred embodiments that utilize a sequence of edge detectors to provide the advantages of being able to detect large overlaps and also provide early detection.

Further, in carrying out the present invention, a system for feeding and transporting documents is provided. Each document has a leading edge and a trailing edge. The system comprises a feeder stage, a transport stage, at least one edge detector, and control logic. The feeder stage includes a controllable feeder and a separator for receiving documents therebetween. The feeder stage is configured to detect a trailing edge of a first document at the feeder. The transport stage is downstream of the feeder stage for receiving documents from the feeder stage. The at least one edge detector is between the feeder stage and the transport stage for detecting passing document edges during operation of the system. Control logic is configured to determine an overlap/gap error, if any, between the first document and a second document following the first document based on the first document trailing edge detection and a second document leading edge detection at the at least one edge detector. The control logic is further configured to control the feeder to correct the overlap/gap error, when the error is present.

Embodiments of the present invention may determine the overlap/gap error in a variety of ways. For example, after the first document trailing edge is detected, the feeder may be operated at a constant velocity until the second document leading edge is detected. The overlap/gap error, if any, between the first document and the second document is determined based on an elapsed time between the first document trailing edge detection and the second document leading edge detection. Further, for example, the system may include a tachometer at the feeder with the tachometer generating an output. The control logic would then be further programmed to determine the overlap/gap error based on the tachometer output between the first document trailing edge detection and the second document leading edge detection. The tachometer may include an encoder and generate a pulse sequence as a tachometer output. Or, the tachometer may generate an analog velocity output as the tachometer output. In addition, systems for feeding and transporting documents in accordance with the present invention may utilize a single edge detector or a sequence of edge detectors, and in the preferred embodiment, a sequence of edge detectors is used.

The advantages associated with embodiments of the present invention are numerous. For example, embodiments of the present invention provide methods and systems for document overlap/gap error detection and correction that measure overlap before the trailing edge of the first document reaches the edge detector downstream of the feeder. The earlier calculation of overlap/gap error leaves a greater distance of the second document with which to perform any correction. Correction is performed by controlling the feeder. Earlier determination of the overlap/gap error may allow for reduced motor requirements for the feeder because earlier detection increases the amount of distance remaining of the second document that is still in the feeder with which to perform correction.

The above object and other objects, features, and advantages of the present invention are readily apparent from the following detailed description of the preferred embodiment when taken in connection with the accompanying drawings.

DETAILED DESCRIPTION OF THE PREFERRED EMBODIMENT

Figure 1:
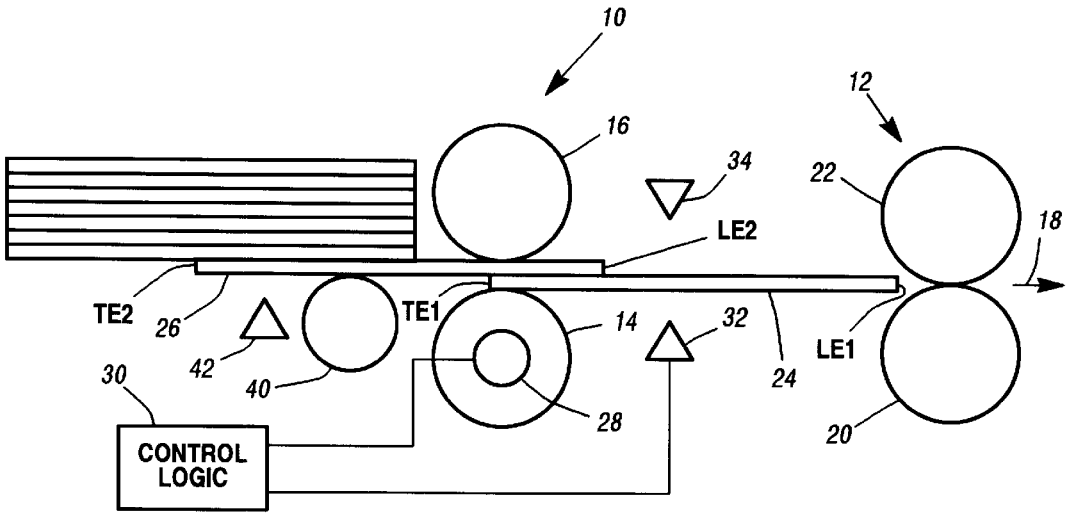
FIG. 1 illustrates a system for feeding and transporting documents according to a single edge detector embodiment of the present invention.

FIG. 1 illustrates a system for feeding and transporting documents.

The system includes a feeder stage 10 and a transport stage 12. Feeder stage 10 includes a feeder 14 and a separator 16. Transport stage 12 is downstream of feeder stage 10, with arrow 18 pointing in the downstream direction. A document leading edge is the more downstream edge while the trailing edge is the more upstream edge. More specifically, a first document 24 has leading edge LE1 and trailing edge TE1, and a second document 26 has leading edge LE2 and trailing edge TE2. Feeder 14 and separator 16 of feeder stage 10 receive a document therebetween. Transport stage 12 is downstream of feeder stage 10 and includes an accelerator driver 20 and an accelerator idler 22 for receiving a document therebetween. The document stack is shown adjacent to separator 16 and includes first, leading, document 24 and second, following, document 26 among other documents in the stack, with the trailing edge TE1 of first document 24 being about to exit feeder 14 and separator 16.

Feeder 14 is a controllable feeder and is controlled to correct an overlap/gap error between two consecutive documents, when an overlap/gap error is present. Feeder stage 10 is configured to detect a trailing edge of first document 24 at feeder 14. As shown in FIG. 1, trailing edge TE1 of first document 24 is at feeder 14 and is about to be detected. Detection may take place in any suitable fashion, and embodiments of the present invention are not limited to any particular form of document trailing edge detection at the feeder. An edge detector 32 is located between feeder stage 10 and transport stage 12 for detecting passing document edges during operation of the system. As shown, edge detector 32 may be a light sensor positioned across from light sender 34 and can detect the presence of none, one, or two documents. Control logic 30 is configured to determine an overlap/gap error, if any, between consecutive documents based on the first document trailing edge detection at feeder 14 and the second document leading edge detection at edge detector 32. Control logic 30 is further configured to control feeder 14 to correct the overlap/gap error, when the error is present. The overlap/gap error may be determined in a variety of ways.

For example, after the first document trailing edge is detected, feeder 14 may be operated at a constant velocity until the second document leading edge is detected. The overlap/gap error is then determined based on an elapsed time between the first document trailing edge detection at feeder 14 and the second document leading edge detection at edge detector 32. Other embodiments may utilize a tachometer 28 at feeder 14 with the tachometer output being supplied to control logic 30. The overlap/gap error would then be determined based on the tachometer output between the first document trailing edge detection at feeder 14 and the second document leading edge detection at edge detector 32. The tachometer may be implemented in any suitable form. For example, the tachometer may include an encoder and generate a pulse sequence as the tachometer output. Or, the tachometer may generate an analog velocity output as the tachometer output.

The components shown in FIG. 1 are preferred, and alternative arrangements are possible. For example, the feeder is shown as a feed wheel 14, but may take other forms. The separator is shown as a separator wheel 16, but also may take other forms such as a belt. As shown, feed wheel 14 rotates clockwise, driven by its own motor, and separator or retarder wheel 16 is fixed or run slowly. Further, the components in transporting portion 12 may take a variety of forms and are shown as an accelerator driver wheel 20 and an accelerator idler wheel 22. In a preferred embodiment, the system includes a suitable nudging device such as nudger wheel 40. It is appreciated that the varying relationships between rotational and surface speeds for different components are taken into account when control logic 30 makes any determinations.

Further, as mentioned previously, any suitable technique may be utilized for detecting the trailing edge of a document at feeder 14. For example, an edge detector 42 may detect the passing of the document trailing edge and a timer (for constant speed feeding) or output from tachometer 28 may be used to determine when the trailing edge reaches feeder 14. Alternatively, if the accelerator idler 22 and accelerator driver 20 are positioned close enough to feeder 14 such that a document is received by accelerator driver 20 and accelerator idler 22 before exiting feeder 14, a tachometer (not specifically shown) at accelerator idler 22 could be used to detect when a document trailing edge exits feeder 14. That is, the grip of accelerator driver 20 and accelerator idler 22 on the document would be less than the grip of feeder 14 and separator 16 on the document such that when a document is simultaneously gripped by feeder 14 and separator 16 and gripped by accelerator driver 20 and accelerator idler 22, the document slips at accelerator driver 20 until the document trailing edge exits feeder 14 and separator 16. The tachometer at accelerator idler 22 would detect an acceleration indicating when the document trailing edge exits feeder 14 and separator 16. The previous two techniques for detecting a document trailing edge at feeder 14 are exemplary, and any suitable technique may be utilized.

With continuing reference to FIG. 1, in which a single edge detector embodiment of a system for feeding and transporting documents is illustrated, feed wheel 14, separator 16, and nudger 40 are typical elements for feeding documents singly from a document stack. Downstream accelerator wheel pair 20 and 22 accept the document from feed wheel 14 and separator 16. The accelerator drive wheel 20 is preferably not driven by the same motor that drives feed wheel 14 because feed wheel 14 is controlled to correct document overlap/gap. In operation, feeder 14 removes one document from the stack and sends it into accelerator driver 20 and accelerator idler 22. Subsequently, the document is transported to other devices for processing. Examples are magnetic ink character recognition (MICR) reading, optical reading of characters, printing, copying, faxing, microfilming, digital imaging, sorting, etc. These functions require that there be space between successive documents for these processes to be reliably performed. That is, a variety of products could benefit from embodiments of the present invention such as copiers, fax machines, sheet feeders for computer printers, automatic teller machines, document image scanners, to name a few.

Feed wheel 14 moves a document into the track while separator 16 functions to hold back the stack of documents. Accelerator driver 20 drives documents at higher speed than feed wheel 14. This speed differential causes space to be developed between two consecutive documents. This space is normally required for actuating pocket selector gates, advancing microfilm, or processing other information.

Normally, separator 16 holds back the following document until the trailing edge of the leading document leaves the nip between feeder 14 and separator 16. Occasionally, the following document will feed earlier, resulting in overlap of, in the example illustrated, first document 24 and second document 26. Depending on the amount of overlap, accelerator driver 20 may still separate these documents but the resulting space may be too small to allow satisfactory operation of pocket selector gates, for example.

In FIG. 1, edge detector 32 is placed just beyond feed wheel 14. The exemplary edge detector detects a visible and/or infrared electromagnetic beam sent across the path of the documents from sender 34. Detector or receiver 32 on the other side of the document path from sender 34 measures the amount of electromagnetic energy that falls on its surface. The amount depends upon the thickness of paper in the beam path. A quick change in detected energy is caused by an edge passing detector 32. The energy change caused by the document edge is sufficient to determine that the edge has arrived.

Feed wheel 14 is driven by a variable speed motor. The feed wheel motor speed can be changed depending upon commands sent to the motor controller. As such, there is normally an encoder or other suitable device for measuring relative displacement of feed wheel 14. Accelerator driver 20 is typically driven by a different motor, normally at constant speed. Feed wheel 14 has a nominal speed, less than the accelerator speed, producing the desired space when documents are not fed overlapped.

Figure 2:
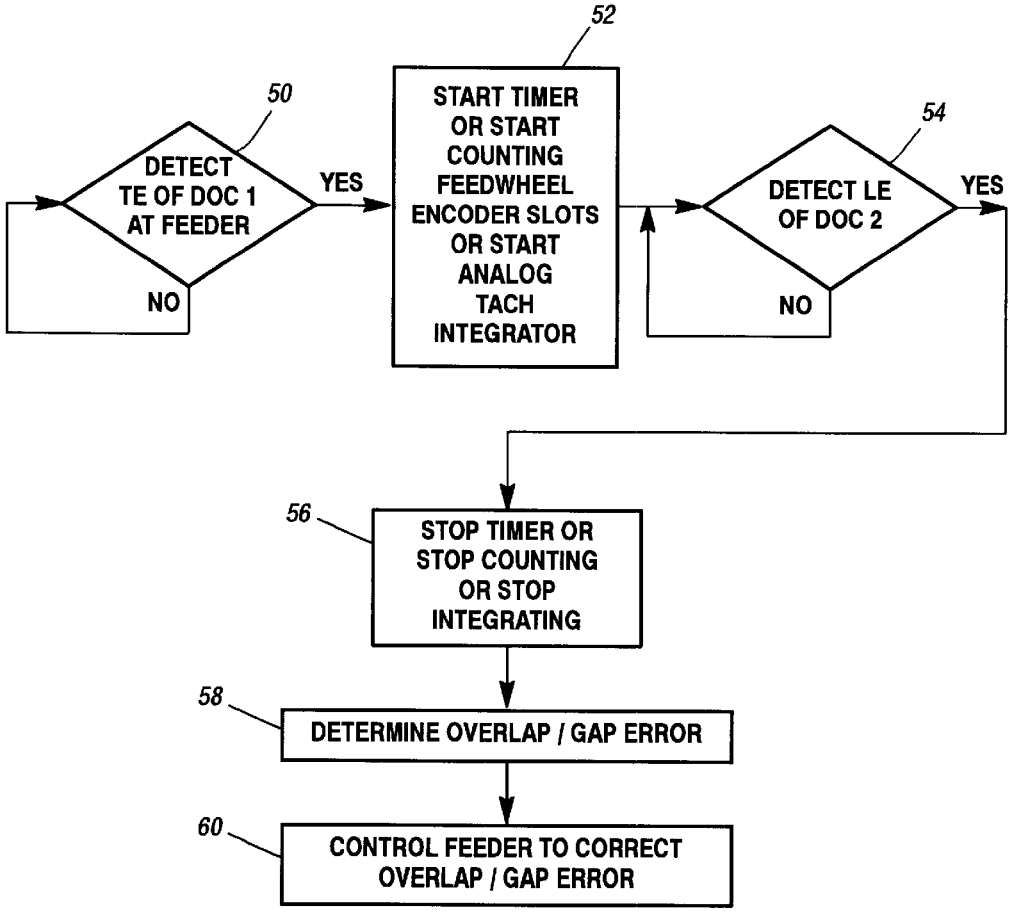
FIG. 2 illustrates a method of document overlap/gap error detection and correction according to a single edge detector embodiment of the present invention.

In FIG. 2, a single edge detector embodiment of a method of document overlap/gap error detection and correction is illustrated. Each document has a leading edge and a trailing edge, with the leading edge being the downstream edge and the trailing edge being the upstream edge. The associated system includes a feeder stage and a transport stage downstream of the feeder stage and in a preferred embodiment is the system shown in FIG. 1. At block 50, a trailing edge of a first document is detected at feeder 14. Embodiments of the present invention use any suitable technique for determining the overlap/gap error based on the first document trailing edge and second document leading edge detections. Assuming that there is an overlap condition, detection of trailing edge TE1 of first document 24 occurs just as first document 24 leaves the feed wheel 14/separator 16 nip. This condition produces an electrical logic signal that starts a timer, starts counting feed wheel encoder slots, or starts an analog integrator depending on the implementation. Also at this time, feed wheel 14 has control of second document 26 and starts to feed it. When the edge detection system detects the leading edge LE2 of second document 26 at edge detector 32, the timer, counter, or integrator is stopped. Blocks 52, 54, and 56 illustrate these steps. Because the feed wheel speed or displacement is known, the amount of overlap can be calculated from the timer value and speed, or the encoder, or the integration result. This can be done in either hard wire electronic logic or with a microprocessor. This step is indicated at block 58.

Once the overlap/gap value is known, hard wire electronic logic or a microprocessor can compute the amount and time of slow down (or speed up) of the feed wheel motor to allow first document 24 to get sufficiently ahead of second document 26 (or allow second document 26 to get sufficiently caught up to first document 24). Then, second document 26 is accelerated (or decelerated) back to the nominal feed wheel speed before its trailing edge leaves the feeder nip. This step is indicated at block 60.

Advantageously, overlap may be measured before the first, leading, document's trailing edge arrives at the downstream sensor 32. Thus, there is greater remaining length of the second, following, document left in the feeder with which to perform the necessary feed wheel motions: namely, deceleration and acceleration. The greater remaining length enables smaller values of deceleration and acceleration, permitting smaller feed wheel motors to be used, thereby operating with more efficiency.

Figure 3:
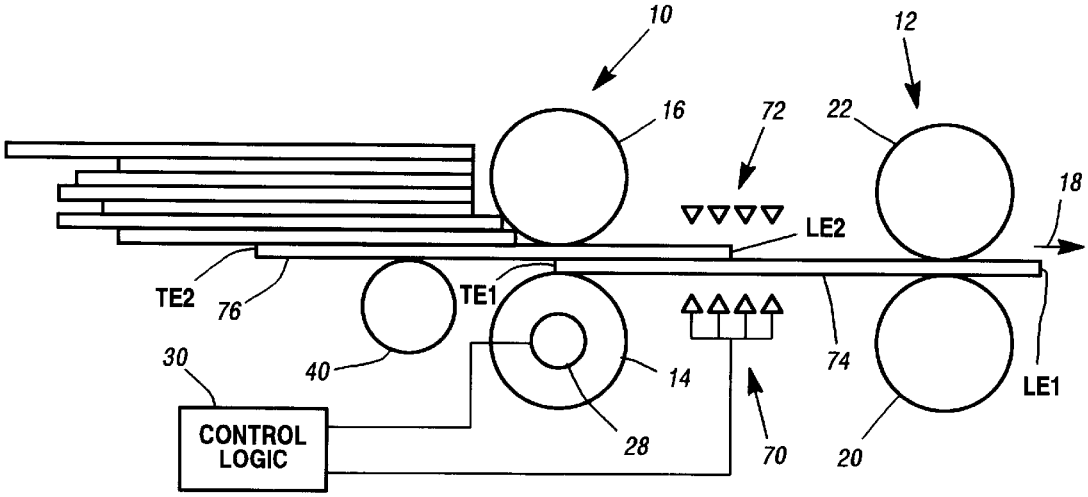
FIG. 3 illustrates a system for feeding and transporting documents according to a multiple edge detector embodiment of the present invention.

FIG. 3 illustrates a multiple edge detector embodiment of a system for feeding and transporting documents. Like reference numerals have been used to indicate like parts. In FIG. 3, the first, leading, document is indicated at 74 and the second, following, document is indicated at 76. A sequence of edge detectors is indicated at 70. At 72, a radiation source is indicated. Receivers and senders 70 and 72, respectively, operate in the same manner as receiver and sender 32 and 34, respectively, of FIG. 1. In the FIG. 1 embodiment, placing edge detector 32 closer to feed wheel 14 provides earlier detection, yet limits the amount of overlap that can be detected because a large overlap would result in the second document leading edge already being past detector 32 at the time when the trailing edge of the first document is detected at feed wheel 14. Placing edge detector 32 closer to accelerator driver 20 allows for detection of greater overlaps, yet does not provide detection as early for smaller overlaps. In FIG. 3, an array 70 of edge detectors is preferred because edge detector array 70 provides both early detection for smaller overlaps and the ability to detect large overlaps. In addition, embodiments utilizing a sequence of sensors would perform better at recognizing edge to edge documents than a single sensor embodiment because the leading document and following document have different velocities as they pass through the sensor array such that if the documents are edge to edge at one part of the array, the documents will not be edge to edge when they are at a different part of the array.

More specifically, FIG. 3 shows an array of light or infrared sensors energized by a light or infrared source on the opposite side of a document path. The amount of radiation falling on each sensor depends upon the presence or absence of a document, and whether there is one or two documents in the radiation path. Therefore, each sensor has three levels of detection: no document, one document, or two documents. The sensors produce electrical outputs that are processed by external circuitry such as control logic 30.

In the event that the trailing edge TE1 of first document 74 is detected at feeder 14 prior to leading edge LE2 of second document 76 reaching the first sensor of the sensor array, processing occurs as described previously for the single sensor embodiments. In the event that, as shown, second document leading edge LE2 has already entered the sensor array when first document trailing edge TE1 is detected at feeder 14, determination of the overlap/gap occurs as follows. FIG. 3 shows first document 74 covering all of the sensors. This occurs when first document trailing edge TE1 is detected at feeder 14. Second document 76 covers some of the sensors, and these sensors will have less radiation falling on them, producing the lowest level of sensor output. The proportion of sensors blocked by second document 76 will locate the leading edge LE2 of second document 76 with respect to feeder 14 because the location of the sensor array is known. Because feeder 14 will start to move second document 76 when first document 74 leaves feeder 14, the overlap of the two documents is essentially second document 76's leading edge location with respect to feeder 14 when the trailing edge TE1 of first document 74 is detected leaving feeder 14.

In the case where first document 74 trailing edge TE1 leaves feeder 14 before second document 76 leading edge LE2 enters the sensor array, the relative displacement of second document 76 until its leading edge LE2 reaches the sensor array is measured starting when first document 74 trailing edge TE1 leaves feeder 14. The difference between this measurement and distance between the feeder and the sensor array entrance is the amount of overlap. The measurement may occur in a variety of ways (for example, block 52, FIG. 2).

Figure 4:
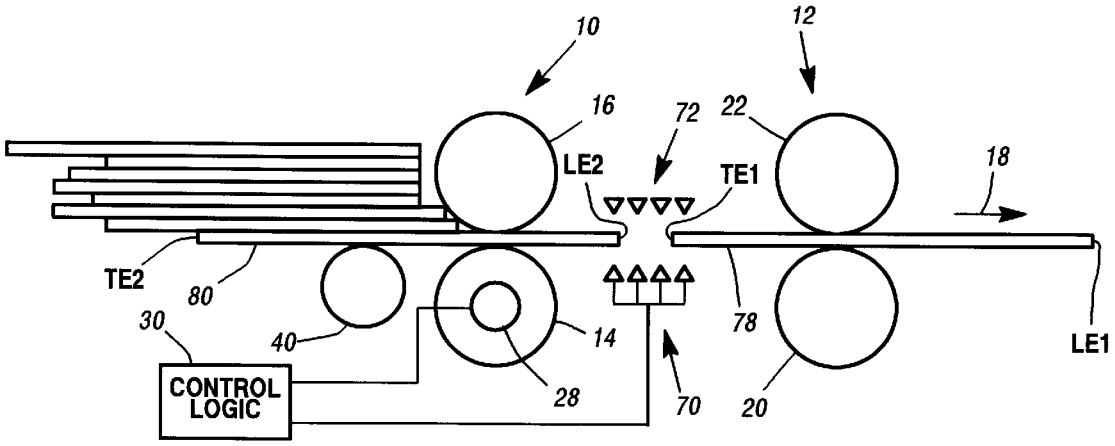
FIG. 4 illustrates the system of FIG. 3 showing an alternative technique for detecting a gap.

In certain situations, and as illustrated in FIG. 4, there may be a space or gap between the documents as the documents pass the single edge detector, or as shown, pass through the sequence of edge detectors. In these situations, the gap may be measured in the same way as described immediately above, that is, by measuring between detection of first document trailing edge TE1 at feeder 14 and the detection of second document leading edge LE2 at the first sensor in the sequence or at the single edge detector. Alternatively, measurements may start when the first document trailing edge TE1 is detected entering the sensor array, or detected at the single sensor. In either approach, measurement would be complete when second document leading edge LE2 reaches the sensor array. That is, overlaps are calculated based on trailing edge TE1 detection at feeder 14 and leading edge LE2 detection at the edge detector(s), while gaps may be measured in the same way or may alternatively be measured directly based on trailing edge TE1 and leading edge LE2 detection at the first detector.

Figure 5:
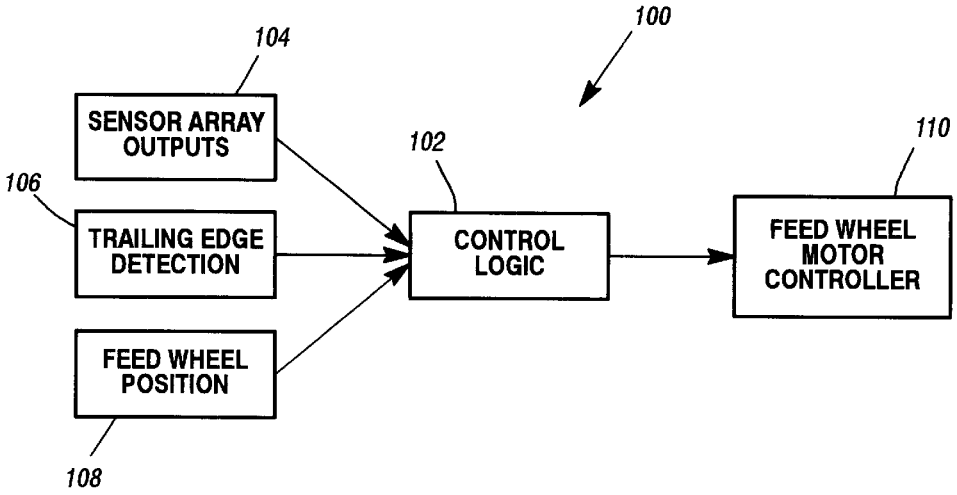
FIG. 5 illustrates a flow diagram for embodiments of methods and systems of the present invention.

FIG. 5 illustrates a general electrical block diagram for systems of the present invention at 100. Control logic 102 receives sensor array outputs 104, trailing edge detection information 106, and feed wheel position information 108. Control logic 102 processes the information as explained above. In addition, it is appreciated that some embodiments use a single sensor while other embodiments use an array of sensors. The output of control logic 102 is sent to a feed wheel motor controller 110 giving it instructions as to what motions are to be performed by the feed wheel motor.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of document overlap/gap error detection and correction in a system for feeding and transporting documents, each document having a leading edge and a trailing edge, the system including a feeder stage and a transport stage downstream of the feeder stage for receiving a document from the feeder stage, the feeder stage including a controllable feeder and a separator for receiving the document therebetween, the system including at least one edge detector between the feeder stage and the transport stage for detecting passing document edges during operation of the system, the method comprising:

detecting a trailing edge of a first document at the feeder;

detecting a leading edge of a second document at the at least one edge detector, the second document following the first document and the second document still being received between the feeder and the separator when the second document leading edge is detected at the at least one edge detector;

determining an overlap/gap error, if any, between the first document and the second document based on the first document trailing edge detection and the second document leading edge detection; and controlling the feeder to correct the overlap/gap error, when the error is present, while the second document is still between the feeder and the separator.

2. The method of claim 1 wherein determining the overlap/gap error further comprises:

after detecting the first document trailing edge, operating the feeder at a constant velocity until detecting the second document leading edge; and determining the overlap/gap error, if any, between the first document and the second document based on an elapsed time between the first document trailing edge detection and the second document leading edge detection.

3. The method of claim 1 wherein determining the overlap/gap error further comprises:

providing a tachometer at the feeder, the tachometer generating an output; and determining the overlap/gap error, if any, between the first document and the second document based on the tachometer output between the first document trailing edge detection and the second document leading edge detection.

4. The method of claim 3 wherein the tachometer includes an encoder and generates a pulse sequence as the tachometer output.

5. The method of claim 3 wherein the tachometer generates an analog velocity output as the tachometer output.

6. The method of claim 1 wherein the at least one edge detector is a single edge detector.

7. The method of claim 1 wherein the at least one edge detector is a sequence of edge detectors.

8. The method of claim 7 wherein determining the overlap/gap error further comprises:

detecting the leading edge of the second document at an edge detector in the sequence at the same time as detecting the trailing edge of the first document at the feeder; and determining the overlap/gap error between the first document and the second document based on the first document trailing edge detection at the feeder and the second document leading edge detection.

9. A system for feeding and transporting documents, each document having a leading edge and a trailing edge, the system comprising:

a feeder stage including a controllable feeder and a separator for receiving documents therebetween, the feeder stage being configured to detect a trailing edge of a first document at the feeder;

a transport stage downstream of the feeder stage for receiving documents from the feeder stage;

at least one edge detector between the feeder stage and the transport stage for detecting passing document edges during operation of the system; and control logic configured to determine an overlap/gap error, if any, between the first document and a second document following the first document based on the first document trailing edge detection and a second document leading edge detection at the at least one edge detector, and to control the feeder to correct the overlap/gap error, when the error is present, while the second document is still between the feeder and the separator.

10. The system of claim 9 wherein the control logic is further configured to determine the overlap/gap error by:

after the first document trailing edge is detected, operating the feeder at a constant velocity until the second document leading edge is detected; and determining the overlap/gap error, if any, between the first document and the second document based on an elapsed time between the first document trailing edge detection and the second document leading edge detection.

11. The system of claim 9 wherein the system further includes a tachometer at the feeder, the tachometer generating an output, and wherein the control logic is further configured to determine the overlap/gap error by:

determining the overlap/gap error, if any, between the first document and the second document based on the tachometer output between the first document trailing edge detection and the second document leading edge detection.

12. The system of claim 11 wherein the tachometer includes an encoder and generates a pulse sequence as the tachometer output.

13. The system of claim 11 wherein the tachometer generates an analog velocity output as the tachometer output.

14. The system of claim 9 wherein the at least one edge detector is a single edge detector.

15. The system of claim 9 wherein the at least one edge detector is a sequence of edge detectors.

* * * * *